United States Patent [19]

Waggoner

[11] 4,396,028

[45] Aug. 2, 1983

[54] SUNTAN LOTION APPLICATOR DEVICE

[76] Inventor: Edward S. Waggoner, 46 Elsworth St., North Patchogue, N.Y. 11772

[21] Appl. No.: 435,910

[22] Filed: Oct. 22, 1982

[51] Int. Cl.[3] ..... A45D 40/26

[52] U.S. Cl. ..... 132/88.7; 15/144 R

[58] Field of Search ..... 132/88.7, 88.5; 401/140, 191; 15/144 R

[56] References Cited

U.S. PATENT DOCUMENTS 2,875,462 3/1959 Wittnebert ..... 401/191 X 3,340,556 9/1967 Allen ..... 15/144 R 4,165,755 8/1979 Cassal ..... 132/88.7

*Primary Examiner*—Gregory E. McNeill

*Attorney, Agent, or Firm*—Leonard Belkin

[57] ABSTRACT

A suntan lotion applicator device consisting of an extensible handle, an applicator holder adjustably mounted on one end of the handle, and a cover for the applicator. The holder is pivotally mounted between two segments of the holder and is provided with recesses for engagement with a device on the handle to engage one of the recesses to maintain a selected annular position of the applicator holder.

3 Claims, 5 Drawing Figures

SUNTAN LOTION APPLICATOR DEVICE

BACKGROUND OF THE INVENTION

This invention relates to a suntan lotion applicator device and more particularly to an applicator device which is readily adjustable when in use and can be conveniently made compact for storage and carrying when not in use.

Lotion applicator devices currently in use are usually devices with long handles to reach parts of the body not accessible by a person's own hands and provided with some sort of a dispenser at the end. Such lotion applicator devices are shown in U.S. Pat. Nos. 2,829,393, 2,976,560, 3,067,450, 3,345,669, 4,078,865, and 4,118,824.

Principal drawbacks of the prior art devices of this type are their lack of ability to adjust the orientation of the applicator to fit the individual's needs and to provide for it being made compact for carrying in a purse or other small package. Typically, a suntan lotion applicator device would be carried to a beach, swimming pool, or other area outside of the home or apartment for use, and it is highly desirable to be able to render it compact for carrying and at the same time to enclose the applicator itself to prevent lotion present from soiling other articles in the purse or carrying case, or to prevent soiling of the applicator itself.

SUMMARY OF THE INVENTION

The present invention overcomes the disadvantages and drawbacks of suntan lotion applicator devices presently in use by providing a portable device which is compact and whose applicator is enclosed when not in use and is adjustable in a very convenient manner when it is being used.

A preferred embodiment of this invention comprises an elongated handle which is extensible, an applicator holder which is mounted on one end of the handle in a pivotal arrangement whereby the user of the device can adjust the angle of the applicator to its most convenient position, and a cover for the applicator. When not in use the device is compact and the applicator covered for convenient carrying.

In one embodiment, a simple to operate mechanical arrangement is provided to release and select one of a finite number of positions of the applicator holder. In another preferred embodiment, a spring is incorporated so that no release is required, making it possible to snap the holder into the position desired.

It is thus a principal object of this invention to provide a portable lotion applicator device which is convenient to carry and easy to use and adjust.

Other objects of this invention will hereinafter become obvious from the following description of preferred embodiments of this invention.

DESCRIPTION OF THE PREFERRED EMBODIMENTS

Figure 1:
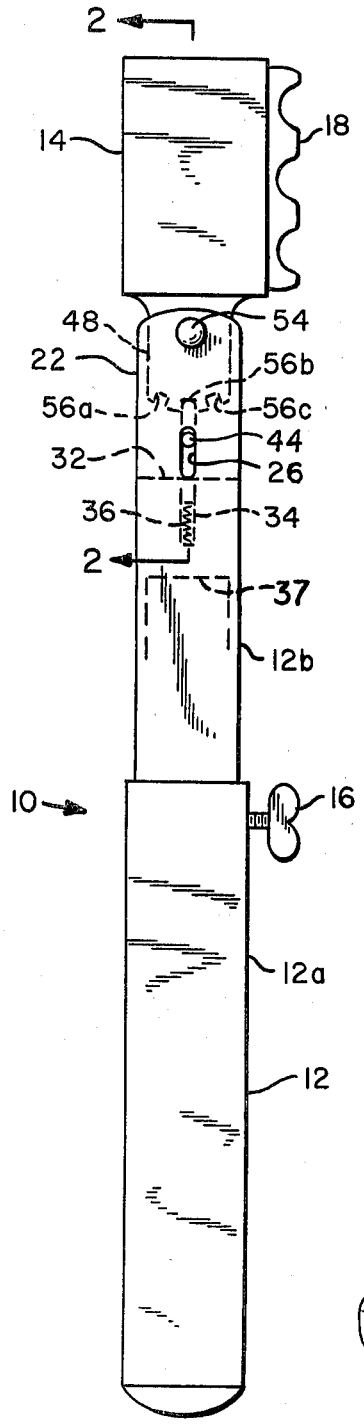
FIG. 1 is an elevation view of a preferred embodiment of this invention.
Figure 2:
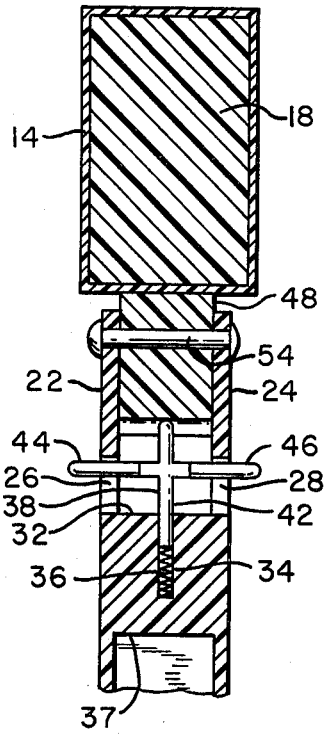
FIG. 2 is a view along 2—2 of FIG. 1.

Referring to FIGS. 1 and 2, there is illustrated a suntan lotion applicator device 10 consisting of a handle 12 having a hollow, female arm 12*a* and a telescoping male arm 12*b* supporting at one end an applicator holder 14.

Handle 12 is square in cross section, but of course, with proper modification could be circular or even oval. Telescoping arm 12*b* could be tight fitting within its female arm 12*a* or a thumb or set screw 16 may be employed to hold the two arms at the point to which they are extended.

Applicator 14 is box-like in shape with an opening on one side to accommodate an applicator 18 which could be a sponge-like material or other suitable material which can be used to spread the lotion.

In order to support applicator holder 14 in accordance with the principles of this invention there is provided on the exposed end of extension arm 12*b* a u-shaped or pronged configuration consisting of two spaced segments 22 and 24 with elongated slots 26 and 28, respectively. On the surface 32 between segments 22 and 24 is a recess or hole 34 to accommodate a spring 36. Arm 12*b*, for purposes of reducing weight, can be hollow below surface 37.

Fitted into the space between segments 22 and 24 is a position lock pin 38 consisting of an elongated, cylindrical body 42 extending into hole 34 and a pair of transversely extending arms 44 and 46 which pass through slots 26 and 28, respectively. Arms 44 and 46 may be threaded onto body 42 to make it possible to insert or remove pin 38, and at the same time, when it is installed, prevent its being dislodged or removed by accident.

The length of slots 26 and 28 is such that when pin 38 is in the position illustrated in FIG. 2, spring 32 will be expanded but remain trapped within its hole 34.

Applicator holder 14 is provided with a pivot shoulder 48 which is rounded as illustrated, is flat on two sides so that it fits between segments 22 and 24, and is provided with three spaced recesses 52*a*, 52*b*, and 52*c* shaped and sized to accommodate the upper tip of body 42 of pin 38.

In the arrangement illustrated in FIGS. 1 and 2, pin 38 is in recess 52*b* thereby maintaining holder 14 in a position lined up with arm 12.

Figure 3:
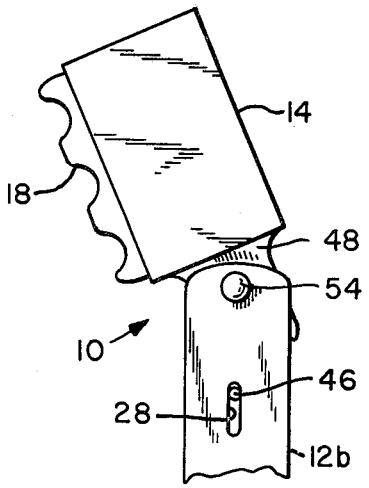
FIG. 3 shows the holder of FIG. 1 in another position.

In order to rotate holder 14 into other positions, a shaft 54 is provided passing through segments 22 and 24, and shoulder 48. Arms 44 and 46 would be depressed against spring 36 until pin 38 is out of recess 52*b*, and holder 14 rotated about shaft 54 in the direction desired so that pin 38 can be released into recess 52*a* or 52*c*. In FIG. 3, pin 38 would be trapped in recess 52*a*, so that the exposed surface of application 18 is at some convenient angle with respect to the long axis of arm 12.

Figure 4:
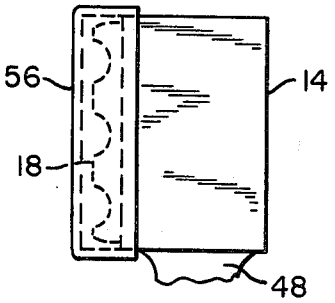
FIG. 4 illustrates the device of FIGS. 1–3 with a cover in place.

A cover 56, illustrated in FIG. 4, is shown on applicator holder 14 fully enclosing applicator 18. Cover 56 snaps into place on holder 14 as is understood in the art when device 10 is not in use. The use and operation of device 10 is quite convenient. For carrying, arm 12 would be telescoped, cover 56 would be snapped into place on holder 14, and the latter would be left in the orientation shown in FIG. 1.

When it is desired to use device 10 for the application of a lotion, arm 12 would be extended to the desired length, set screw 16 tightened to hold the desired length of arm 12, cover 56 removed, and then holder 14 would be rotated as described above to the desired angular position. Then lotion would be dispensed onto the surface of applicator 18. To stow device 10 after use, the procedure would be reversed. Cover 56 would keep applicator 18 clean when stored.

In the embodiment just described, arms 44 and 46 must be moved against spring 36 and held there to adjust the angle of holder 14.

In an alternative embodiment of this invention it is possible to provide a more simplified arrangement for making the adjustment of holder 14.

Figure 5:
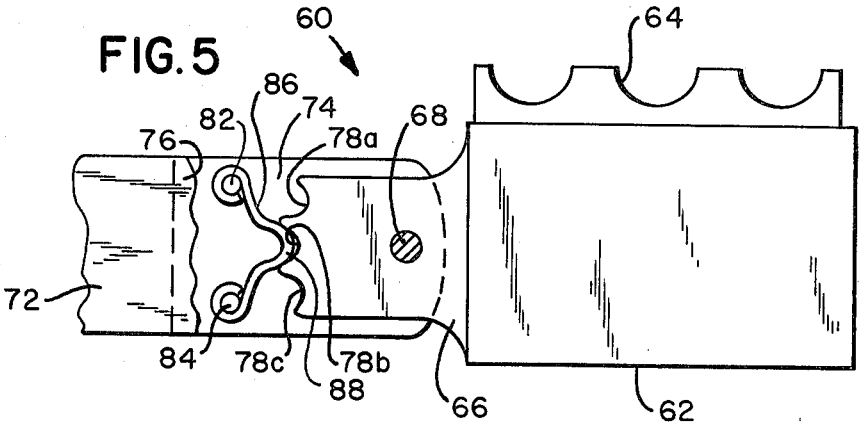
FIG. 5 is an elevation view of part of another embodiment of this invention partially cut away.

Referring to FIG. 5 there is illustrated a portion of applicator device 60 similar to device 10 described above except for the features to be now described. Applicator holder 62 with applicator 64 has a pivot shoulder 66 supported on a shaft 68. Handle 72 has a pair of segments 74 and 76 (the latter of which is cut away to show more clearly the arrangement within) through which shaft 68 extends.

Shoulder 66 has three rounded recesses 78*a*, 78*b* and 78*c*. A pair of pins 82 and 84 extending between segments 74 and 76 support the end of a spring 86 which is preformed to form a protuberance 88 to fit into either of the recesses 78*a*, 78*b*, or 78*c*. In FIG. 5, protuberance 88 is shown in recess 78*b*, with holder 62 aligned with handle 72. Holder 62 can be rotated to either of two other positions, snapping protuberance 88 into either recess 78*a* or 78*c*, depending on the position desired for holder 62. Of course, more recesses can be provided if more positions are desired.

In the configuration of FIG. 5, the position of holder 62 can be more easily changed, and this construction would be especially useful when the user has a minor physical disability or when the extra convenience is desired or needed.

It is thus seen there has been provided a particularly useful device for the application of suntan or other lotions, or as is evident, medication. The adjustable nature of the device is particularly useful to insure the uniform application of the liquid in places difficult for an individual to reach on himself. This is especially the case where a medication is to be applied and it is necessary to apply the liquid thoroughly yet uniformly.

While only certain preferred embodiments of this invention have been described, it is understood that many variations thereof are possible without departing from the principles of this invention.

What is claimed is:

1. A lotion applicator device comprising:

a. an elongated handle adjustable between a fully extended position and a fully retracted position;

b. applicator means having a lotion applicator spreader mounted on one end of said handle including means for adjusting the angle said applicator spreader makes with respect to the long axis of said handle;

c. said adjusting means including a plurality of finite positions of said applicator means and means to select one of said positions; and d. means for enclosing said lotion applicator spreader when said device is not in use;

e. said adjusting means including a pair of pronged segments on one end of said elongated handle, a shoulder extending from said applicator means into the space between said segments, a shaft passing through said segments and said shoulder thereby permitting pivoting of said applicator means about said shaft, recesses formed in the periphery of said shoulder, and means mounted in said handle extending into the space between said segments for selectively engaging said recesses to position said applicator means at a desired angle.

2. The applicator device of claim 1 in which said selectively engaging means includes a pin spring biased into one of said recesses, said pin having arms to permit said pin to be depressed to allow rotation of said application means to select another recess.

3. The applicator device of claim 1 in which said selectively engaging means includes spring means having a protuberance to mate with one of said recesses, said applicator means being rotatable to snap said protuberance into any selected recess to adjust the angular position of said applicator means.

* * * * *